US007721919B2

(12) United States Patent
Vanblaere et al.

(10) Patent No.: US 7,721,919 B2
(45) Date of Patent: May 25, 2010

(54) SYSTEM FOR APPLYING A WORKING PRESSURE TO A CONTENT OF A PRESSURE PACKAGE WITH THE AID OF A PROPELLANT

(75) Inventors: Roland Frans Cyrille Cornelius Vanblaere, Houthalen Helchteren (BE); Willy Leonard Alice Kegels, Sint Gillis Waas (BE)

(73) Assignee: IPS Patent S.A., Baar (CH)

( * ) Notice: Subject to any disclaimer, the term of this patent is extended or adjusted under 35 U.S.C. 154(b) by 1189 days.

(21) Appl. No.: 10/542,842

(22) PCT Filed: Jan. 20, 2004

(86) PCT No.: PCT/IB2004/000163

§ 371 (c)(1),
(2), (4) Date: Sep. 23, 2005

(87) PCT Pub. No.: WO2004/065260

PCT Pub. Date: Aug. 5, 2004

(65) Prior Publication Data

US 2006/0054237 A1 Mar. 16, 2006

(30) Foreign Application Priority Data

Jan. 21, 2003 (NL) ..... 1022455

(51) Int. Cl.
*B65B 3/04* (2006.01)

(52) U.S. Cl. ..... 222/399; 222/389; 222/396; 222/61; 141/18

(58) Field of Classification Search ..... 222/399, 222/396, 389, 394, 402.16, 635, 55, 61; 141/20, 141/113, 3, 18, 39, 47, 49, 51, 64; 251/149.6; 137/571, 576

See application file for complete search history.

(56) References Cited

U.S. PATENT DOCUMENTS

| | | | |
|---|---|---|---|
| 35,402 | A | 5/1862 | Thompson |
| 2,163,597 | A | 6/1939 | Grove |
| 2,195,242 | A | 3/1940 | Dow |

(Continued)

FOREIGN PATENT DOCUMENTS

| | | | |
|---|---|---|---|
| BE | 1004018 | A3 | 9/1992 |

(Continued)

*Primary Examiner*—J. Casimer Jacyna
(74) *Attorney, Agent, or Firm*—Fish & Richardson P.C.

(57) ABSTRACT

A system for applying a working pressure to a content of a pressure package. The system comprises a pressure package configured to hold a content to be delivered, a high-pressure chamber configured to hold a propellant, a pressure controller connected to the high pressure chamber by a feed-through and configured to control the working pressure on the content of the pressure package with the aid of the propellant on the basis of a predetermined reference pressure, and a movable member positionable in at least a control position and a neutral position. The movable member, in the control position, clears the feed-through to enable control of the working pressure. The movable member, in the neutral position, blocks the feed-through, so that control of the working pressure is then impossible. The movable member has a handle for positioning the movable member in the neutral position or in the control position.

45 Claims, 2 Drawing Sheets

U.S. PATENT DOCUMENTS

| | | | | | |
|---|---|---|---|---|---|
| 2,261,364 | A | | 11/1941 | Grove | |
| 2,618,908 | A | | 11/1952 | Salter et al. | |
| 3,120,377 | A | | 2/1964 | Lipschultz et al. | |
| 3,140,802 | A | | 7/1964 | Everett | |
| 3,228,559 | A | * | 1/1966 | Couffer | 222/61 |
| 3,347,417 | A | * | 10/1967 | Puster | 222/61 |
| 3,421,698 | A | | 1/1969 | Baltzer | |
| 3,556,128 | A | | 1/1971 | Scaglione | |
| 3,561,644 | A | | 2/1971 | Works et al. | |
| 3,913,613 | A | | 10/1975 | Kostjunin et al. | |
| 4,257,560 | A | | 3/1981 | Diamond | |
| 4,456,155 | A | | 6/1984 | Miyata et al. | |
| 4,487,334 | A | | 12/1984 | Werding | |
| 4,561,465 | A | | 12/1985 | Rogers | |
| 4,650,094 | A | | 3/1987 | Werding | |
| 4,940,169 | A | | 7/1990 | Ball | |
| 5,033,505 | A | | 7/1991 | Eidsmore | |
| 5,042,697 | A | | 8/1991 | Warren | |
| 5,090,595 | A | | 2/1992 | Vandoninck | |
| 5,181,636 | A | * | 1/1993 | Anderson et al. | 222/389 |
| 5,285,931 | A | | 2/1994 | Alfons | |
| 5,303,734 | A | | 4/1994 | Eidsmore | |
| 5,341,968 | A | | 8/1994 | Vandoninck | |
| 5,368,207 | A | | 11/1994 | Cruysberghs | |
| 5,514,135 | A | * | 5/1996 | Earle | 606/93 |
| 6,026,850 | A | | 2/2000 | Newton et al. | |
| 6,145,712 | A | | 11/2000 | Benoist | |
| 6,616,017 | B2 | * | 9/2003 | van 't Hoff | 222/389 |
| 6,652,704 | B2 | * | 11/2003 | Green | 156/308.6 |
| 6,851,575 | B2 | | 2/2005 | Van't Hoff | |
| 2002/0179151 | A1 | | 12/2002 | Van't Hoff | |

FOREIGN PATENT DOCUMENTS

| | | | |
|---|---|---|---|
| CH | 405851 | A | 1/1966 |
| DE | 1220688 | B | 7/1966 |
| DE | 4241074 | A1 | 1/1994 |
| EP | 0826608 | A1 | 3/1998 |
| EP | 0960827 | A1 | 12/1999 |
| FR | 474467 | A | 2/1915 |
| FR | 474476 | A | 2/1915 |
| FR | 973108 | | 2/1951 |
| FR | 1216484 | A | 4/1960 |
| FR | 1303048 | | 7/1962 |
| FR | 1390963 | | 3/1964 |
| FR | 1463058 | | 12/1966 |
| FR | 2208313 | | 6/1974 |
| FR | 2698341 | | 5/1994 |
| FR | 2754584 | | 4/1998 |
| GB | 1268569 | | 3/1972 |
| WO | WO 90/15377 | | 12/1990 |
| WO | WO 99/62791 | | 12/1999 |
| WO | WO 00/35774 | | 6/2000 |
| WO | WO 01/09009 | | 2/2001 |

* cited by examiner

SYSTEM FOR APPLYING A WORKING PRESSURE TO A CONTENT OF A PRESSURE PACKAGE WITH THE AID OF A PROPELLANT

RELATED APPLICATIONS

This application is the national stage of international application no. PCT/IB2004/000163, filed 20 Jan. 2004, and claims priority to Dutch application no. NL1022455, filed 21 Jan. 2003, both of which applications are incorporated herein by reference.

BACKGROUND

The invention relates to a system for applying a working pressure to a content of a pressure package with the aid of a propellant, the system being provided with: a pressure package and a gas supply device comprising a pressure controller and a high-pressure chamber for storage of the propellant, the gas supply device being provided with a feed-through connecting the high-pressure chamber and the pressure controller for supplying propellant from the high-pressure chamber to the pressure controller, the pressure controller being further arranged to control the working pressure on the content of the pressure package with the aid of the propellant on the basis of a reference pressure.

Such a system is known per se. Typically, the known systems are arranged for, shortly after the manufacture of the pressure package with the content, providing a working pressure on the content with the aid of the propellant. However, after a working pressure has been provided; it may take a long time yet before the content is to be expelled from the pressure package under the influence of the working pressure. In fact, it may be that the pressure package with the content, as a product, is still to be traded, transported, possibly stored, sold, etc., before the product is eventually put to use. To prevent the initially applied working pressure from decreasing in the period between the provision of the working pressure and the use of the product, for instance as a result of diffusion of propellants through pressure package material, the pressure package material should be of a very high quality. As a consequence, the required pressure package material is of an expensive quality. The protracted exertion of the working pressure on the content and inner walls of the pressure package can moreover have adverse effects both on the content and on the pressure package.

SUMMARY

The object of the invention is to provide a system that meets at least one of the above-mentioned disadvantages.

The object contemplated is achieved with a system according to the invention which is characterized in that the gas supply device is further provided with a movable member which can be brought at least in a control position and in a neutral position, while the movable member in the control position clears the feed-through to enable control of the working pressure, and the movable member in the neutral position blocks the feed-through, so that control of the working pressure is then impossible.

In use, the propellant can be included in the high-pressure chamber with a relatively high main pressure when the movable member has been brought in a neutral position. The movable member then blocks the feed-through situated between the pressure chamber and the pressure controller. At any time to be chosen freely, the movable member can be brought into the control position. In that case, the feed-through situated between the pressure chamber and the pressure controller is cleared to enable the propellant to flow from the high-pressure chamber to the pressure controller. As a result of the relatively high pressure in the high-pressure chamber, at least a part of the propellant then flows from the high-pressure chamber via the feed-through to the pressure controller for controlling a working pressure on the content of the pressure package. As stated, the time at which a user decides to apply the working pressure to the content of the pressure package is to be chosen freely. This means that the working pressure can for instance be provided shortly before use of the content of the pressure package. Since in the system according to the invention it is not necessary for the working pressure to be applied to the content from the time of manufacture of the pressure package with the content, the adverse effects of the working pressure on the content and/or the pressure package can at least partly be avoided. Also, less high requirements can be imposed on the pressure package materials.

Optionally, the control of the working pressure can be set out of operation by bringing the movable member back into the neutral position. In that case, if any part of the content of the pressure package flows out, the working pressure on the content of the pressure package is not sustained by the propellant. An additional advantage is that in that case, when the working pressure decreases, a high-viscous content will not of itself readily leave the pressure package through, for instance, an outflow opening which is not closed.

A particular embodiment of the system according to the invention is characterized in that the movable member can further be brought in a filling position, while the movable member in the filling position establishes a fluid communication between the high-pressure chamber and an inlet of the system to enable the high-pressure chamber to be filled with propellant, while the movable member in the filling position in addition blocks the feed-through.

For such a system, it is not even necessary for the propellant to be included in the pressure chamber already during the manufacture of the system. In a stage after the manufacture of the system, the propellant can be included in the pressure chamber from, for instance, a supply container, by connecting the supply container to the fluid communication. It is even possible to replenish the pressure chamber if this should prove necessary during use.

Preferably, in the control position, the movable member blocks the fluid communication. This prevents the supply container from obtaining a direct fluid communication with the pressure controller.

Further, preferably, the movable member blocks the fluid communication in the neutral position as well. This means that it is possible to position the movable member such that both the feed-through and the fluid communication are blocked. This may be favorable for periods in which it is not necessary for the pressure chamber to be filled or replenished and it is not necessary for the working pressure on the content of the pressure package to be sustained. Such a period can occur, for instance, during storage and/or transport.

Preferably, the movable member comprises a rod which is movable in axial direction. The rod can comprise a first and a second end, with the first end of the rod, in the neutral position, closing off the feed-through. Preferably, furthermore, in the neutral position, a circumferential surface of the first end of the rod situated substantially parallel to the axial direction makes contact with an inner wall of the feed-through situated substantially parallel to the axial direction, and thereby closes off the feed-through. This provides the advantage that the feed-through and the first end of the rod will each have predetermined dimensions which remain at least substantially constant during the use of the system. Tearing of the feed-through and/or wear of the first end of the rod is highly unlikely and therefore the closure will possess an at least virtually constant quality. As a consequence, the position of the rod relative to the feed-through in the neutral position will hardly change, if at all, during use, which will facilitate the use of the system as regards placing the movable member in the neutral position and possibly also in the filling position, compared with a situation where the feed-through can vary in dimensions and the closure is dependent on the exact position of the movable member. In fact, the exact position does not need to be the same when the dimensions of the feed-through can increase during use as a result of, for instance, tearing, indentation and the like.

The invention further relates to a gas supply device for use in such a system.

BRIEF DESCRIPTION OF DRAWINGS

The invention is presently elucidated with reference to a drawing. In the drawing.

DETAILED DESCRIPTION

Figure 1:
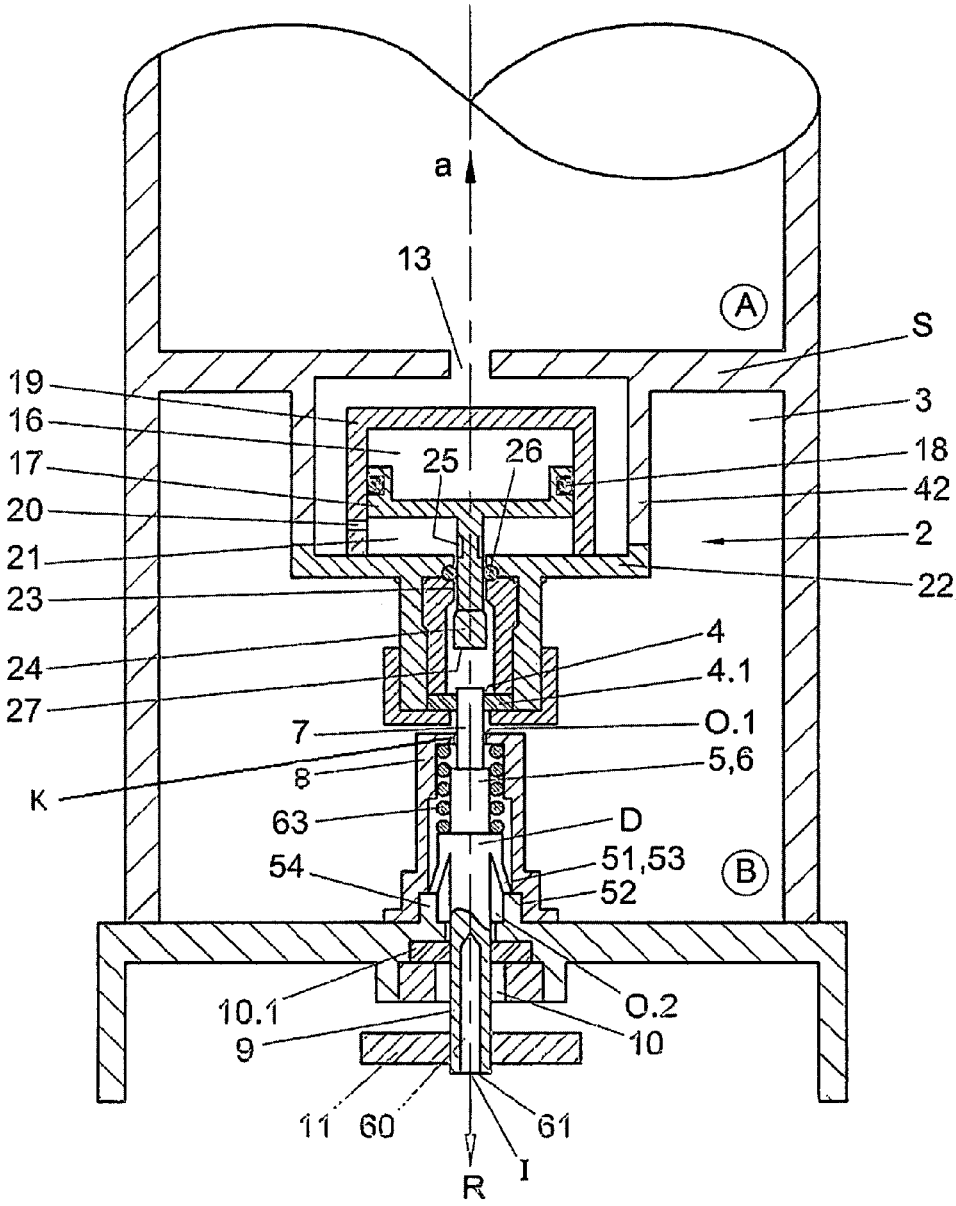
FIG. 1 shows a first embodiment of a system according to the invention.

FIG. 1 shows a system 1 for applying a working pressure to a content of a pressure package with the aid of a propellant. To that end, the system 1 is provided with: a pressure package A and a gas supply device B comprising a pressure controller 2 and a high-pressure chamber 3 for storage of the propellant. The gas supply device B is provided with a feed-through 4 which connects the high-pressure chamber 3 and the pressure controller 2 to enable the propellant to flow from the high-pressure chamber 3 to the pressure controller 2. The feed-through 4, in many cases, is a prefabricated feed-through, that is, a feed-through which is already present before the first use of the system. The pressure controller 2 is further arranged, on the basis of a reference pressure, to control the working pressure on the content of the package A with the aid of the propellant. This will be described in more detail hereinbelow. The gas supply device B is further provided with a movable member 5 which can be brought at least in a control position and in a neutral position. In the control position, the movable member clears the feed-through 4 to enable control of the working pressure. In the neutral position, the movable member blocks the feed-through, so that control of the working pressure is then impossible. In the embodiment shown in FIG. 1, the movable member 5 for that purpose comprises a rod 6, which is movable in axial direction. Rod 6 comprises a first end 7. In a neutral position of the rod 6, the first end 7 closes off the feed-through 4. In the neutral position, more specifically, a circumferential wall of the first end 7 of the rod situated substantially parallel to the axial direction makes contact with an inner wall of the feed-through situated substantially parallel to the axial direction, thereby closing off the feed-through. Preferably, the circumferential wall and the inner wall are each of cylinder-shaped design. In FIG. 1, the movable member 5 is shown in the neutral position. In the example shown, the gas supply device B is further provided with a housing 8, which is included in the high-pressure chamber 3. A portion of the movable member 5 is surrounded by the housing 8. Rod 6 is further provided with a second end 9. The system is further provided with a passage 10, situated between the pressure chamber 3 and an ambient space O of the system, which can effect a fluid communication between the pressure chamber 3 and the ambient space O. In the control position and in the neutral position, the rod 6 has its second end 9 extending through the passage 10 and thereby closes off this passage 10. The second end of the rod 6 is provided with a pull element 11, with which the movable member 5, 6 is movable into the control position.

The system works as follows. As a starting point, the movable member 5, 6 is in the neutral position, as drawn in FIG. 1. The first end 7 of the rod 6 then closes the feed-through 4. In use, propellant under high pressure is contained in the high-pressure chamber 3. In the condition shown, this propellant cannot flow through the feed-through 4 to the pressure controller 2. The pressure controller 2, whose operation is further explained hereinbelow, therefore cannot control the working pressure on the content of the package with the aid of the propellant. In other words, in the neutral position, no propellant can be supplied from the high-pressure chamber 3 to the pressure package A for applying a working pressure to the content of the pressure package A. Controlling the working pressure is then impossible.

When with the aid of the propellant a working pressure is to be applied to the content of the pressure package, the movable member is brought into the control position. To that end, the pull element 11 is pulled in the direction of arrow R. In the control position, the movable member 5, 6 clears the feed-through 4 to enable control of the working pressure. In other words, it is then possible for the propellant contained in the high-pressure chamber 3 to flow through the feed-through 4 to the pressure controller 2. The pressure controller 2 is described at length in WO 99/62791, shown in detail in FIG. 1 of this reference and described in detail in this reference in the description of FIG. 1. Accordingly, hereinbelow, the operation of the pressure controller 2 will be discussed only briefly. The pressure controller is arranged, on the basis of a predetermined reference pressure, to control the working pressure on the content of the package with the aid of a propellant. The working pressure is a pressure to be kept substantially constant. To that end, the pressure controller 2 is provided with a reference pressure chamber 16 in which, for obtaining the reference pressure, for instance a gas is included. The pressure controller 2 is furthermore provided with a closing member 17, movable relative to the reference pressure chamber 16, which in this example is designed as a plunger. The plunger 17 is provided with a sealing ring 18 for preserving a gas included in the reference pressure chamber 16 with the reference pressure. The pressure controller 2 is further provided with a cylinder-shaped cap 19 which, together with the plunger 17, bounds the reference pressure chamber 16. The cap 19 is provided with a through-going recess 20 for effecting a gas communication between inlet opening 13 of the pressure package A and a space 21 included between the plunger and a closure 22 closing off the cap 19. For establishing a gas communication between the through-going recess 20 and the pressure package A, a part of the pressure controller 2 is included in the cylinder 42 which at one end adjoins a partition wall S situated between the pressure package A and the gas supply device B, and at another end is also closed off by the closure 22. In the partition wall S there is an inlet opening 13 which, at an end proximal to the gas supply device, terminates within the cylinder 42 and at an end remote from the gas supply device terminates in the pressure package A. The through-going recess 20 terminates on one side in the cylinder 42 and on the other side in the space 21. Closure 22 is further provided with a pressure control passage 23 in which a stem 24 of the plunger 17 is received with a close fit. Stem 24 of the plunger 17 is provided with an annular recess 25 to enable effectuation of a gas communication between the high-pressure chamber 3 and the space 21. Stem 24 of the plunger 17 can move in the pressure control passage 23 in the direction of arrow R, such that a gas communication between the space 21 and the high-pressure chamber 3 is effected. When there is a gas communication, the sealing ring 26 extends in the annular recess 25, thereby leaving open a fluid path between the sealing ring 26 and the stem 24. The plunger 17 can move in the direction of arrow "a" in such a manner that the gas communication between the space 21 and the high-pressure chamber 3 is closed again. In FIG. 1 the gas communication is closed, since the sealing ring 26 presses against the cylinder wall of stem 24. The effectuation of a gas communication between the space 21 and the high-pressure chamber 3 is determined by the position of stem 24 relative to the sealing ring 26. The closure of the gas communication between the space 21 and the high-pressure chamber 3 is therefore taken care of by the sealing ring 26 arranged in the pressure control passage 23. In use, the reference pressure in the reference pressure chamber 16 will be chosen to be slightly lower than the working pressure to be exerted on the content of the pressure package A.

The pressure controller 2 controls as follows. When the pressure in the pressure package A is lower than the reference pressure in the reference pressure chamber 16, the pressure in the space 21 will also be lower than the reference pressure in the reference pressure chamber 16. As a consequence, the plunger 17 moves in the direction of arrow R, at least when the reference pressure in the reference pressure chamber 16 is higher than the pressure in the space 21. It should be noted that a high pressure of the gas in the high-pressure chamber 3 as exerted on a subsurface 27 will hardly make any contribution to the position of the plunger 17 since this subsurface 27 is very small. As said, when plunger 17 with the stem 24 moves in the direction of arrow R, a gas communication between the space 21 and the high-pressure chamber 3 is effected in the pressure control passage 23 via the annular recess 25. The propellant operatively contained in the high-pressure chamber will flow via this gas communication to the space 21. Via the through-going recess 20 provided in the cap 19, the propellant will flow via inlet opening 13 to the pressure package A. When in the pressure package A the pressure is slightly higher than the reference pressure in the reference pressure chamber 16, the plunger 17 will move in the direction of arrow "a". The gas communication between the space 21 and the high-pressure chamber 3 is thereby closed off by the contact between the sealing ring 26 and the stem 24. The operating pressure prevailing in the pressure package A is therefore slightly higher than the reference pressure in the reference pressure chamber 16. It is now possible to bring the movable member 5, 6 in the neutral position again by pushing the handle 11 in the direction of arrow "a". The first end 7 of the rod 6 will then project through the feed-through 4 again, and thereby close off the feed-through 4. It is then no longer possible to control the working pressure in the pressure package A when, for instance, owing to a user, a part of the content has flowed from the pressure package and the pressure in the pressure package has thereby been lowered. In other words, when the movable member is in the neutral position, then, upon opening of the pressure package, the operating pressure will not be controlled. Should a user, after having closed the pressure package A again, wish to apply the working pressure to the remainder of the content of the pressure package A again after all, the user should bring the movable member in the control position by pulling the handle 11 in the direction of arrow R. The rod 6 then moves in the axial direction of the rod, in the direction of arrow R, and thereby clears the feed-through 4. It is then possible again for propellant to flow from the high-pressure chamber 3 through the feed-through 4 to the pressure controller 2. The pressure controller 2 can then control the working pressure on the content of the pressure package A again in the manner described above.

In the embodiment shown in FIG. 1, the movable member 5, 6 is fixable in the control position. To that end, the rod is provided with first fixing means 51 on a part of the rod 6 situated between the first end and the second end 9 thereof. The pressure chamber 3 is provided with second fixing means 52. The first and second fixing means 51, 52 can cooperate for the purpose of keeping the movable member 5, 6 in the control position. The first fixing means 51 comprise, for instance, a part 53 which is flexible and projects with respect to the rod 6. The second fixing means 52 comprise, for instance, a ring 54 arranged around the circumferential surface of the rod 6 in such a way that upon placement of the rod 6 in the control position, the flexible part 53 is clamped between the ring 54 and the rod 6 for fixing the rod 6. The first fixing means 51 shown will curl up upon movement of the rod 6 into the control position and be locked, clamped between the ring 54 and a circumferential surface of the rod 6. However, it is also possible to use first fixing means which, for instance, are indented to some extent when the rod 6 is brought into the control position. When the rod 6, if so desired, is brought into a neutral position by pushing the rod 6 in the direction of arrow "a", the first flexible parts 51 can be released from the clamped position between the circumferential surface of the rod 6 and the ring 54.

In the embodiment shown by way of example in FIG. 1, the movable member 6 can further be brought into a filling position for the purpose of filling the high-pressure chamber 3 with propellant. In the filling position, the movable member 5 effects a fluid communication between the high-pressure chamber 3 and the ambient space O of the system to enable the high-pressure chamber 3 to be filled with propellant. In the filling position, the movable member further blocks the feed-through 4. The gas supply device B in this example is provided with a spring 63 which prevents the possibility of the movable member ending up in the filling position by itself. For bringing the movable member 5 from the control position into the filling position, a second end 9 of the rod 6 is pushed against the spring force of the spring 63, in the direction of arrow "a". For the purpose of filling, the rod 6 in this example is provided with a channel 60 which extends from a first position 61 adjacent the second end 9 on the surface of the rod 6, through the rod 6 as far as a second position in the direction of the first end 7 on the circumferential surface of the rod 6. The distance between the first position 61 and the second position 62 is such that when the rod 6 has been brought into the filling position, the first position is situated outside the high-pressure chamber 3 and the second position is located within the high-pressure chamber 3. Furthermore, the distance is such that when the rod 6 has been brought into the neutral position or into the control position, the first position 61 and the second position 62 are situated outside the high-pressure chamber 3. In other words, when the rod 6 has been brought into the filling position, the channel 60 constitutes the fluid communication between the high-pressure chamber 3 and an inlet I of the system to enable the high-pressure chamber 3 to be filled with propellant. In use, typically, for filling the high-pressure chamber 3, a supply container, not shown, will be connected to the channel 60. The inside of the housing 8 has a continuous fluid communication with the high-pressure chamber 3. This makes it possible for the high-pressure chamber 3 to be filled with propellant in the filling position. In such an embodiment, in the control position, the movable member 5, 6 blocks the fluid communication between the high-pressure chamber 3 and the inlet I of the system. As already said, the movable member 6 clears the feed-through 4 in the control position. The movable member 6 in the filling position effects the fluid communication between the high-pressure chamber 3 and an inlet I of the system, and in the filling position blocks the feed-through 4. In the neutral position of rod 6, as shown in FIG. 1, both the feed-through 4 and the fluid communication between the high-pressure chamber 3 and the inlet I are blocked.

The spring 63 and at least a part of the movable member 5, 6 are surrounded by the housing 8. The ring 54, mentioned earlier, is accommodated in the housing 8. The spring 63 sits around the rod 6, and the inner side of the housing 8 is provided with a collar K against which the spring 63 sits. Housing 8 is further provided with a first opening O.1 and a second opening O.2. The first end 7 of the rod 6 extends through the first opening O.1. The second opening O.2 links up with the passage 10. Rod 6 is further provided with a thickening D situated between the first end 7 and a second end 9, such that the rod is confined in the housing 8. The thickening D is such as to fit neither through the first opening O.1 nor through the second opening O.2 of the housing 8. It will be clear that the feed-through 4 is provided with a suitable sealing ring 4.1. It will further be clear that the passage 10 is provided with a suitable sealing ring 10.1.

The system may be of two-part design. A first part can then comprise the pressure package and a second part can comprise the gas supply device B. As shown in FIG. 1, the first part and the second part can be integrally connected with each other. It is also possible, however, to market the pressure package A separately from the gas supply device B with the pressure controller. In such an embodiment of the system, the first part is connectable with the second part. The pressure package A can also, for instance, be designed for single use whereas the gas supply device B is designed to be used many times. In that case, the first part and the second part are detachably connectable with each other.

Figure 2:
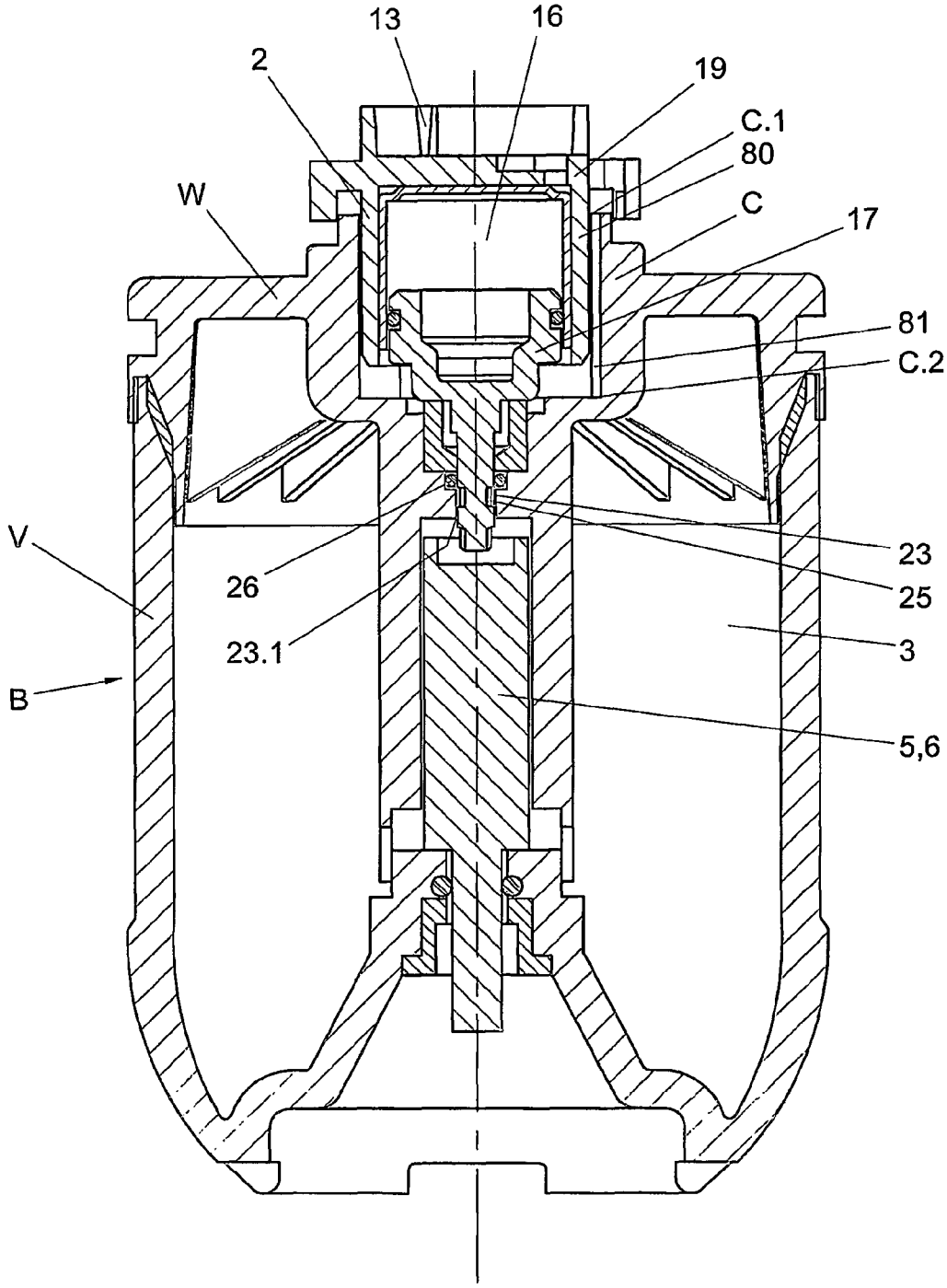
FIG. 2 shows a second embodiment of a system according to the invention.

FIG. 2 shows a gas supply device B which is connectable with a pressure package A. Equal reference numerals here refer to equal parts such as these have been discussed in the discussion of the embodiment shown in FIG. 1. In this case, the system is of two-part design. The first part then comprises the pressure package A, not shown in FIG. 2, and the second part then comprises the gas supply device B shown in FIG. 2. In this embodiment, it is optionally also possible for the first part and the second part to be detachably connectable with each other. Thus, the second part, that is, the gas supply device B, can first be used with a first pressure package and then be used with a second pressure package, possibly to be subsequently used with the first pressure package again. The high-pressure chamber 3 in this embodiment is filled with high pressurized propellant. The operation of the embodiment shown in FIG. 2 further corresponds broadly to the operation of the embodiment shown in FIG. 1. A few particular aspects of the gas supply device B shown in FIG. 2 will be discussed hereinbelow. In this case, the gas supply device B comprises a pressure controller 2 included outside the high-pressure chamber 3. The high-pressure chamber 3 comprises a circularly symmetrical vessel V, with which propellant is prevented from diffusing through the walls (bold-type hatched) of the vessel V in the direction of the high-pressure controller 2.

In the example according to FIG. 2, the high-pressure controller 2 is received in a cylinder-shaped recess C of an outer wall W of the vessel V. The pressure controller 2 comprises a cap 19, situated at a first end C.1 of the cylinder-shaped recess C, by means of which the recess C is closed off. The cap 19 is provided with a cylinder jacket 80 extending in the direction of the vessel V. In this cylinder jacket 80, a plunger 17 is accommodated. The space between the cap 19, the cylinder jacket 80 and the plunger 17 forms the reference chamber 1. In this example, the cap 19 closes off the cylinder-shaped recess C. The cylinder jacket 80 does not have its entire outer circumference abutting against the cylinder-shaped inner wall of the cylinder-shaped recess C, that is, there is a channel 81 present between the outer walls of the cylinder jacket 80 and the inner walls of the cylinder-shaped recess C. Further, the cylinder jacket 80 extends to a point spaced from a bottom C2 situated at a second end C.2 of the cylinder-shaped recess C. In the bottom C2 there is the pressure control passage 23 with which, analogously to the pressure control passage 23 shown in FIG. 1, a gas communication can be established between the space 21 and the high-pressure chamber 3 when the movable member 6 has been brought in the control position.

The cap 19 is provided with a recess (not shown) which extends through the cap from a position contiguous to the channel 81 as far as the outflow opening 13. Between the space 21 and the outflow opening 13, therefore, a continuous gas communication is present.

Through movement of movable member 5 in the direction of arrow "a", the movable member is brought in the neutral position, since a fluid communication between the pressure controller 2 and the high-pressure chamber 3 is then closed off. In FIG. 2, the movable member 5 is in the control position, since there is a gas communication between the high-pressure chamber 3 and an end 23.1 of the pressure control passage 23.

Naturally, it is also possible for the system to comprise a supply container with propellant. In that case, this supply container can be connected to a portion situated outside the high-pressure chamber 3 of a movable member 5, 6 which can be brought into a filling position. The supply container is then connected to the inlet I.

The pressure package may be provided with a content which is expelled under pressure from the pressure package A through an outlet opening (not shown), situated, for instance, opposite the pressure controller opening 13. Thus, the pressure package A can, for instance, have a viscous liquid as content. This viscous liquid can for instance comprise a cement. To be considered here, for instance, is a silicone cement or an acrylic cement. The gas supply device B, for instance such as it is shown in FIG. 2, can then be included in a silicone paste gun.

The invention is not limited in any way to the exemplary embodiment shown. Thus, the movable member 5 can also comprise a part of the pressure chamber wall. The gas supply device B can for instance be designed such that the rod, in the filling position, through depression with the aid of a supply container outlet, ends up entirely within the pressure chamber, no longer closes off passage 10 and in this way establishes the second fluid communication. The spring and the housing may be arranged to keep the movable member in the neutral position with the spring relaxed. The flexible parts 53 may then also be designed to spring.

The fixation of the movable member, incidentally, will preferably be temporary. However, embodiments in which the movable member is fixed a single time and definitively are also conceivable and are also understood to belong to the invention.

A lock for one or all possible positions of the movable member can also be situated outside the pressure chamber, so that a user can operate such lock by hand. In that case, the position of the movable member can be clearly visible to a user.

The system may further be provided with a chamber which is openable prior to a first use, which chamber is included in the feed-through. Use is now understood to mean the provision of the working pressure from the gas supply device for the first time. The first end of the rod can in that case be provided with an opener facing the openable wall, for opening the openable wall before the system is brought into the control position for the first time. The openable wall can be an additional sealing capable of preventing leakage of propellant from the gas supply device before the gas supply device is taken into use. The opener referred to can comprise a pointed part and the openable wall can be designed to be pierceable with the pointed part.

All such variants are understood to fall within the framework of the invention.

The invention claimed is:

1. A system, comprising:

a pressure package configured to hold a content to be delivered;

a high-pressure chamber configured to hold a propellant;

a pressure controller comprising a reference pressure chamber, a pressure control passage provided between the high-pressure chamber and the pressure package, and a closing member movable relative to the reference pressure chamber for opening and closing the pressure control passage, the closing member being configured to control a working pressure, the working pressure being applied to the content of the pressure package with the aid of the propellant, the working pressure being determined on the basis of a predetermined reference pressure in the reference pressure chamber, and the pressure controller being further connected to the high-pressure chamber by a feed-through; and a movable member positionable in the feed-through in at least a control position and a neutral position;

wherein the movable member, in the control position, clears the feed-through to enable control of the working pressure by the pressure controller, and the movable member, in the neutral position, blocks the feed-through, so that control of the working pressure by the pressure controller is then impossible.

2. The system of claim 1, wherein the movable member comprises a rod that is provided with a first fixing means on a part of the rod situated between a first end and a second end of the rod, the first fixing means being configured to fix the movable member in the control position.

3. The system of claim 1, wherein the movable member comprises a rod and the movable member is provided with a channel that extends through the rod from a first position to a second position at a distance from the first position, wherein the distance is such that when the movable member has been brought into the neutral position or into the control position, the first position and the second position are situated outside the high-pressure chamber, wherein the movable member can further be brought into a filling position, wherein the distance between the first position and the second position is such that when the rod has been brought into the filling position, the first position is situated outside the high-pressure chamber, wherein, in the filling position, the channel constitutes a fluid communication between the high-pressure chamber and an ambient space of the system to enable the high-pressure chamber to be filled with the propellant, while further the movable member in the filling position blocks the feed-through.

4. The system of claim 3, wherein the movable member in the control position blocks the fluid communication.

5. The system of claim 3 wherein the movable member blocks the fluid communication in the neutral position.

6. The system of claim 3, wherein the movable member is provided with a spring which prevents the possibility of the movable member ending up in the filling position by itself.

7. The system of claim 3, wherein the rod is movable in an axial direction.

8. The system of claim 7, wherein the rod comprises a first end, the first end of the rod in the neutral position closing off the feed-through.

9. The system of claim 8, wherein, in the neutral position, a circumferential surface of the first end of the rod situated substantially parallel to the axial direction makes contact with an inner wall of the feed-through situated substantially parallel to the axial direction, and thereby closes off the feed-through.

10. The system of claim 9, wherein the circumferential wall and the inner wall are each of cylinder-shaped design.

11. The system of claim 8, wherein the first end of the rod in the filing position closes off the feed-through.

12. The system of claim 8, wherein the rod comprises a second end and that the system is provided with a passage, situated between the high-pressure chamber and the inlet of the system, which can affect the fluid communication between the pressure chamber and the inlet, while the rod in the control position and in the neutral position extends by the second end thereof through the passage and thereby closes off this passage.

13. The system of claim 12, wherein the rod is provided with a channel which extends from a first position adjacent the second end on the surface of the rod as far as a second position in the direction of the first end on the circumferential surface of the rod, while the distance between the first position and the second position is such that when the rod has been brought into the filling position the first position is situated outside the pressure chamber and the second position is situated inside the pressure chamber, and such that when the rod has been brought into the neutral position or into the control position, the first position and the second position are situated outside the pressure chamber.

14. The system of claim 12, wherein the rod is provided with first fixing means on a part of the rod situated between the first and the second end, and that the pressure chamber is provided with second fixing means, the first and the second fixing means being capable of cooperating for the purpose of keeping the movable member in the control position.

15. The system of claim 14, wherein the first fixing means comprises a part which is flexible and projects with respect to the rod, and the second fixing means comprises a ring arranged around the circumferential surface of the rod, in such a way that upon placement of the rod in the control position, the flexible part is clamped between the ring and the rod for fixing the rod.

16. The system of claim 8, wherein the rod comprises a second end, the second end provided with a pull member with which the movable member is movable into the control position.

17. The system of claim 8, wherein the rod has a second end of the rod pullable in a direction away from the pressure chamber for placing the movable member in the control position.

18. The system of claim 1, further comprising:

a housing which is included in the high-pressure chamber and by which at least a part of the movable member is surrounded.

19. The system of claim 18, wherein the housing is provided with a first and a second opening, the first end of the rod extending through the first opening, and the second opening linking up with the passage.

20. The system of claim 1, wherein the system is of multipart design, with a first part comprising the pressure package, and a second part comprising the pressure controller and the high-pressure chamber.

21. The system of claim 20, wherein the first part and the second part are integrally connected with each other.

22. The system of claim 20, wherein the first part and the second part are connectable with each other.

23. The system of claim 22, wherein the first part and the second part are detachably connectable with each other.

24. The system of claim 1, wherein the system is configured to deliver a viscous liquid.

25. The system of claim 24, wherein the viscous liquid comprises a cement.

26. A gas supply device, comprising:

a high-pressure chamber configured to hold a propellant;

a pressure controller comprising a reference pressure chamber, a pressure control passage provided between the high-pressure chamber and a pressure package, and a closing member movable relative to the reference pressure chamber for opening and closing the pressure control passage, the closing member being configured to control a working pressure, the working pressure being applied to a content of the pressure package with the aid of the propellant, the working pressure being determined on the basis of a predetermined reference pressure in the reference pressure chamber, the pressure package being configured to hold the content to be delivered, and the pressure controller being further connected to the high-pressure chamber by a feed-through; and a movable member positionable in the feed-through in at least a control position and a neutral position; and wherein the movable member, in the control position, clears the feed-through to enable control of the working pressure by the pressure controller, and the movable member, in the neutral position, blocks the feed-through, so that control of the working pressure by the pressure controller is then impossible.

27. An article, comprising:

a working chamber configured to hold, at a working pressure, a material to be delivered;

a propellant reservoir configured to hold a propellant at a pressure higher than the working pressure;

a pressure controller comprising a reference pressure chamber, a pressure control passage provided between the propellant reservoir and the working chamber, and a closing member movable relative to the reference pressure chamber for opening and closing the pressure control passage, the closing member being configured to control the working pressure on the basis of a predetermined reference pressure in the reference pressure chamber, the pressure controller being further connected to the propellant reservoir by a feed-through and configured to use propellant that has passed along the feed-through from the propellant reservoir to the pressure controller to maintain the working pressure of the material to be delivered; and a movable member selectively positionable in the feed-through between a neutral position and a working position; and wherein the movable member, when in the neutral position, blocks the passage of propellant along the feed-through from the propellant reservoir to the pressure controller so that control of the working pressure by the pressure controller is then impossible, and, when in the working position, allows the passage of propellant along the feed-through from the propellant reservoir to the pressure controller to enable control of the working pressure by the pressure controller.

28. The article of claim 27, wherein the pressure controller comprises a pressure control chamber configured to hold a fluid having a reference pressure and the working pressure is determined by the reference pressure.

29. A system according to claim 1, wherein the feed-through comprises a prefabricated feed-though, the prefabricated feed-through being present before first use of the system.

30. A system, comprising:

a pressure package configured to hold a content to be delivered;

a high-pressure chamber configured to hold a propellant;

a pressure controller connected to the high pressure chamber by a feed-through and configured to control a working pressure, the working pressure being applied to the content of the pressure package with the aid of the propellant, the working pressure being determined on the basis of a predetermined reference pressure; and a movable member distinct from the pressure controller, the movable member comprising a rod that is provided with a first fixing means on a part of the rod situated between a first end and a second end of the rod, the first fixing means being configured to fix the movable member in the control position, and the movable member being positionable in at least a control position and a neutral position;

wherein the movable member, in the control position, clears the feed-through to enable control of the working pressure, and the movable member, in the neutral position, blocks the feed-through, so that control of the working pressure is then impossible.

31. A system, comprising:

a pressure package configured to hold a content to be delivered;

a high-pressure chamber configured to hold a propellant;

a pressure controller connected to the high pressure chamber by a feed-through and configured to control a working pressure, the working pressure being applied to the content of the pressure package with the aid of the propellant, the working pressure being determined on the basis of a predetermined reference pressure; and a movable member distinct from the pressure controller, the movable member being positionable in at least a control position and a neutral position;

wherein the movable member comprises a rod and the movable member is provided with a channel that extends through the rod from a first position to a second position at a distance from the first position; and the distance is such that when the movable member has been brought into the neutral position or into the control position, the first position and the second position are situated outside the high-pressure chamber;

wherein the movable member can further be brought into a filling position, the distance between the first position and the second position is such that when the rod has been brought into the filling position, the first position is situated outside the high-pressure chamber; in the filling position, the channel constitutes a fluid communication between the high-pressure chamber and an ambient space of the system to enable the high-pressure chamber to be filled with the propellant; and the movable member in the filling position blocks the feed-through; and wherein the movable member, in the control position, clears the feed-through to enable control of the working pressure, and the movable member, in the neutral position, blocks the feed-through, so that control of the working pressure is then impossible.

32. The system of claim 31, wherein the movable member in the control position blocks the fluid communication.

33. The system of claim 31, wherein the movable member blocks the fluid communication in the neutral position.

34. The system of claim 31, wherein the movable member is provided with a spring which prevents the possibility of the movable member ending up in the filling position by itself.

35. The system of claim 31, wherein the rod is movable in an axial direction.

36. The system of claim 35, wherein the rod comprises a first end, the first end of the rod in the neutral position closing off the feed-through.

37. The system of claim 36, wherein, in the neutral position, a circumferential surface of the first end of the rod situated substantially parallel to the axial direction makes contact with an inner wall of the feed-through situated substantially parallel to the axial direction, and thereby closes off the feed-through.

38. The system of claim 37, wherein the circumferential wall and the inner wall are each of cylinder-shaped design.

39. The system of claim 36, wherein the first end of the rod in the filling position closes off the feed-through.

40. The system of claim 36, wherein the rod comprises a second end and that the system is provided with a passage, situated between the high-pressure chamber and the inlet of the system, which can affect the fluid communication between the pressure chamber and the inlet, while the rod in the control position and in the neutral position extends by the second end thereof through the passage and thereby closes off this passage.

41. The system of claim 40, wherein the rod is provided with a channel which extends from a first position adjacent the second end on the surface of the rod as far as a second position in the direction of the first end on the circumferential surface of the rod, while the distance between the first position and the second position is such that when the rod has been brought into the filling position the first position is situated outside the pressure chamber and the second position is situated inside the pressure chamber, and such that when the rod has been brought into the neutral position or into the control position, the first position and the second position are situated outside the pressure chamber.

42. The system of claim 40, wherein the rod is provided with first fixing means on a part of the rod situated between the first and the second end, and that the pressure chamber is provided with second fixing means, the first and the second fixing means being capable of cooperating for the purpose of keeping the movable member in the control position.

43. The system of claim 42, wherein the first fixing means comprises a part which is flexible and projects with respect to the rod, and the second fixing means comprises a ring arranged around the circumferential surface of the rod, in such a way that upon placement of the rod in the control position, the flexible part is clamped between the ring and the rod for fixing the rod.

44. The system of claim 36, wherein the rod comprises a second end, the second end provided with a pull member with which the movable member is movable into the control position.

45. The system of claim 36, wherein the rod has a second end of the rod pullable in a direction away from the pressure chamber for placing the movable member in the control position.

* * * * *